US010794550B2

(12) United States Patent
Pritchett

(10) Patent No.: US 10,794,550 B2
(45) Date of Patent: Oct. 6, 2020

(54) MULTI-DIRECTIONAL FLASHLIGHT

(71) Applicant: Ronnie Pritchett, Ramona, CA (US)

(72) Inventor: Ronnie Pritchett, Ramona, CA (US)

(73) Assignee: TRIPLELITE LLC, Ramona, CA (US)

( * ) Notice: Subject to any disclaimer, the term of this patent is extended or adjusted under 35 U.S.C. 154(b) by 0 days.

(21) Appl. No.: 15/397,703

(22) Filed: Jan. 3, 2017

(65) Prior Publication Data

US 2017/0114964 A1 Apr. 27, 2017

Related U.S. Application Data

(63) Continuation of application No. 13/473,173, filed on May 16, 2012, now Pat. No. 9,534,750.

(51) Int. Cl.

| | |
|---|---|
| ***F21L 4/00*** | (2006.01) |
| ***F21L 4/02*** | (2006.01) |
| ***F21V 5/00*** | (2018.01) |
| ***F21V 7/00*** | (2006.01) |
| ***H05B 45/00*** | (2020.01) |
| ***H05B 45/10*** | (2020.01) |
| ***F21V 23/02*** | (2006.01) |
| ***F21V 23/04*** | (2006.01) |
| *F21Y 115/10* | (2016.01) |

(52) U.S. Cl.

CPC ..... *F21L 4/022* (2013.01); *F21L 4/027* (2013.01); *F21V 5/006* (2013.01); *F21V 7/0075* (2013.01); *F21V 7/0083* (2013.01); *F21V 23/02* (2013.01); *F21V 23/0414* (2013.01); *H05B 45/00* (2020.01); *H05B 45/10* (2020.01); *F21Y 2115/10* (2016.08)

(58) Field of Classification Search

CPC .. F21Y 2101/02; F21Y 2103/003; F21L 4/02; F21L 4/00; F21L 4/027; F21L 4/08; F21L 4/005; F21L 4/022; F21K 9/135; F21K 9/1355; F21K 9/00

USPC ..... 362/184–185

See application file for complete search history.

(56) References Cited

U.S. PATENT DOCUMENTS

| | | | | |
|---|---|---|---|---|
| 4,937,713 | A * | 6/1990 | Holt | F21L 15/02 362/186 |
| 5,077,644 | A * | 12/1991 | Schaller | F21L 4/022 362/184 |
| 5,353,208 | A | 10/1994 | Moore | |
| 5,558,430 | A * | 9/1996 | Booty, Jr. | F21L 4/02 362/184 |

(Continued)

FOREIGN PATENT DOCUMENTS

| | | |
|---|---|---|
| CN | 1902432 | 1/2007 |
| DE | 20004105 | 5/2000 |

(Continued)

OTHER PUBLICATIONS

Energy Star® Program Requirements for Integral LED Lamps Partner Commitments (incorporated-by-reference into PROGL) (Year: 2010).*

(Continued)

*Primary Examiner* — Gerald J Sufleta, II

(74) *Attorney, Agent, or Firm* — Snell & Wilmer L.L.P.

(57) ABSTRACT

There is provided a hand held flashlight having different intensity and direction of projected light controlled by switches which function independently or pently.

12 Claims, 3 Drawing Sheets

(56) References Cited

U.S. PATENT DOCUMENTS 5,580,156 A * 12/1996 Suzuki ..... B60Q 7/00 116/63 P
5,630,661 A 5/1997 Fox
6,158,874 A * 12/2000 Brustein ..... F21L 4/022 362/184
6,357,893 B1 * 3/2002 Belliveau ..... F21L 4/027 362/285
7,214,952 B2 5/2007 Klipstein et al.
7,327,254 B2 * 2/2008 Chen ..... H05B 47/105 340/545.2
7,387,402 B1 6/2008 Lui
7,594,738 B1 * 9/2009 Lin ..... F21V 23/006 362/218
7,674,003 B2 * 3/2010 Sharrah ..... H05B 39/041 362/205
7,682,037 B1 * 3/2010 Hose ..... G01N 21/255 362/184
7,815,337 B2 * 10/2010 Grossman ..... H01M 2/1055 362/189
7,845,827 B2 * 12/2010 Tarter ..... F21L 4/027 362/240
8,550,654 B2 * 10/2013 Olsen ..... F41G 1/35 362/102
8,807,785 B2 * 8/2014 Ivey ..... F21V 23/06 362/217.02
8,939,603 B2 * 1/2015 Huang ..... F21V 19/0045 362/218
2002/0109986 A1 * 8/2002 Siegel ..... F21L 14/00 362/202
2003/0184999 A1 * 10/2003 Neiser ..... F21V 14/025 362/184
2004/0095757 A1 * 5/2004 Hsien ..... F21V 5/04 362/202
2004/0136184 A1 * 7/2004 Cheng ..... F21V 21/116 362/186
2004/0136185 A1 * 7/2004 Sharrah ..... F21V 15/01 362/202
2004/0190286 A1 * 9/2004 Chapman ..... F21V 5/048 362/171
2005/0007777 A1 * 1/2005 Klipstein ..... F21L 4/027 362/244
2005/0088843 A1 4/2005 Chapman
2006/0056176 A1 * 3/2006 Au ..... F21L 4/005 362/188
2006/0067077 A1 * 3/2006 Kumthampinij ..... F21L 4/027 362/294
2006/0262526 A1 * 11/2006 Dubois ..... F21L 14/023 362/184
2007/0064415 A1 * 3/2007 Wood ..... F21V 14/045 362/205
2007/0153512 A1 * 7/2007 Hendrie ..... F21L 4/027 362/231
2007/0159816 A1 * 7/2007 Bayat ..... F21V 7/0075 362/184
2007/0177378 A1 * 8/2007 Wu ..... F21L 4/027 362/184
2007/0236931 A1 * 10/2007 Chien ..... H04N 5/2252 362/249.07
2007/0258235 A1 * 11/2007 Brockel ..... F21V 7/28 362/190
2008/0180946 A1 7/2008 Kim et al.
2008/0205036 A1 * 8/2008 Tarter ..... F21L 4/04 362/105
2009/0189541 A1 7/2009 Crawford et al.
2010/0172135 A1 * 7/2010 Holder ..... G02B 19/0061 362/249.14
2010/0177508 A1 * 7/2010 Maglica ..... F21V 29/74 362/183
2010/0254122 A1 * 10/2010 Bayat ..... F21V 23/0414 362/187
2011/0170280 A1 * 7/2011 Soto ..... A42B 3/044 362/105
2012/0026732 A1 * 2/2012 Fricke ..... F21V 14/02 362/231
2012/0081915 A1 * 4/2012 Foote ..... B60Q 1/245 362/494
2013/0141908 A1 * 6/2013 Rodriguez ..... F21V 5/04 362/240
2013/0194796 A1 * 8/2013 Progl ..... F21K 9/232 362/235
2013/0301257 A1 * 11/2013 Britt ..... H01L 25/0753 362/231

FOREIGN PATENT DOCUMENTS

DE 20206201 12/2008
WO 2005057080 6/2005
WO 2008157772 12/2008

OTHER PUBLICATIONS

PCT; International Search Report and Written Opinion dated Jul. 31, 2013 in Application No. PCT/US2013/041472.
PCT; International Preliminary Report on Patentability dated Nov. 18, 2014 in Application No. PCT/US2013/041472.

* cited by examiner

MULTI-DIRECTIONAL FLASHLIGHT

REFERENCE TO RELATED PATENT APPLICATION

This patent application is a continuation of and claims priority to U.S. patent application Ser. No. 13/473,173, filed May 16, 2012, now U.S. Pat. No. 9,534,750, issued Jan. 3, 2017, which application is herein incorporated by reference in its entirety.

FIELD

The present invention relates to a hand held flashlight having a different direction and intensity of projected light. More particular, there is provided a flashlight which comprises multidirectional and intensity stationary light emitting source.

BACKGROUND

Traditional flashlights are normally provided with a reflector having rotational symmetry. That is, the reflector has a shaped formed by rotating a generatrix along the longitudinal axis passing through the bulb of the flashlight.

U.S. Pat. No. 7,387,402 discloses a multiple lens LED flashlight which provides one or more wide angle projections of light as well as a concentrated light beam. Sets of LEDs are mounted to separate circuit boards.

U.S. Pat. No. 5,630,661 discloses a flashlight utilizing halogen lamps having variable fields of illumination with adjustably positioned lens.

SUMMARY

According to the invention there is provided a flashlight comprising at least three light emitting bulbs within reflectors which direct light either to the sides or to the front where the light can also be emitted in at least 180 degrees. A dimmer switch for each bulb is provided whereby the light intensity is controlled for each bulb depending upon a direction required to be used.

It is therefore a general object of the invention to provide a flashlight which has multiple directions of light emission and intensity.

It is a further object of the invention to provide a flashlight which emits light to one or two sides.

It is another object of the invention to provide a flashlight with reflectors that captures and redirects light in a preselected beam.

These and other objects and advantages will become apparent from a reading of the preferred embodiments together with the drawings.

DESCRIPTION

Figure 1:
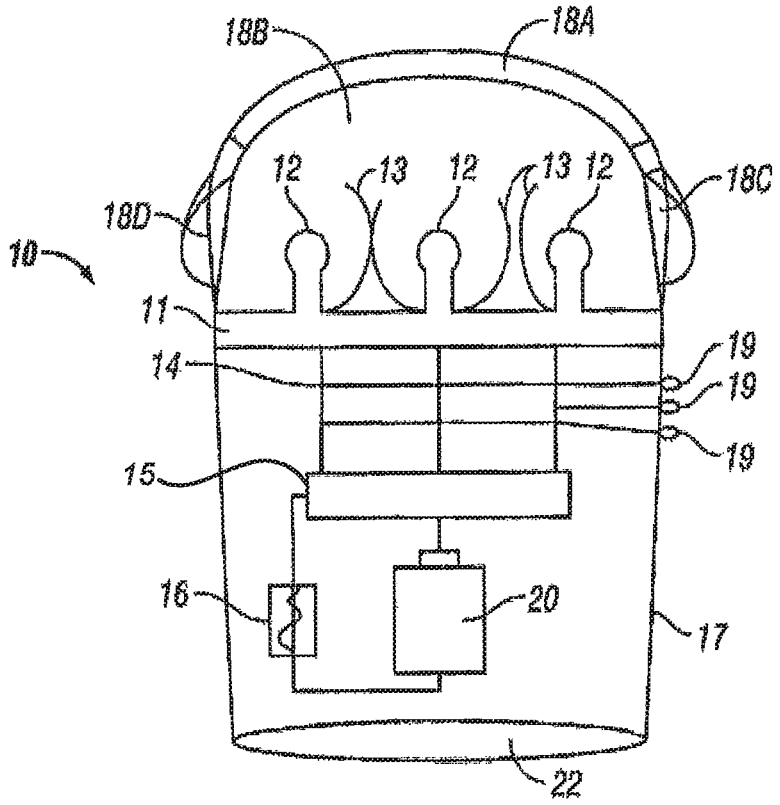
FIG. 1 is a top elevation in cross-section of the flashlight of the invention.

With reference to FIG. 1 there is provided a flashlight (10) comprising a tubular housing (17) made of any suitable material, such as but not limited to plastic or aluminum. The illustrated elongated housing extends between a large end (18) and a small removable end or cover (22).

At the large end (18) is a transparent cover (18A) defining a chamber (18B) sized and configured to receive a bulb housing (11) which contains at least three light emitting bulbs (12) which can have an incandescent filament or preferably light emitting diodes (LEDs). The LEDs can have any size, shape and color. The bulbs (12) are each housed in reflectors (13). The reflectors (13) extend upwardly around the bulbs (12) to form a socket for the bulbs (12). The two side reflectors direct light to the sides and the middle reflector (13) directs light to the front so that the light is emitted when all three bulbs (12) are activated and the light is emitted at least 180 degrees. The reflectors (13) may be in the shape of a paraboloid or other similar shape to capture and redirect light from a bulb in a preselected beam.

The bulb housing (11) may be removable to provide access to the battery (20).

The bulbs (12) may be at an angle with respect to the reflector (13) or the reflector may be shaped to capture substantially all the light produced by the bulb and redirect it toward a direction in a predetermined pattern.

The reflector is made typically from a plastic material which is coated on at least one surface with a light-reflecting material such as silver, aluminum or other similar material.

A standard electronic ballast (15) is provided for converting battery voltage from the battery through a dimmer switch (16) to the bulbs (12). Alternatively there is provided a dimmer switch for each of the bulbs (12) so that the intensity of light emitted can vary with each bulb.

Electrical circuitry (14) is provided for connecting the electronic ballast (15) to the bulbs (12) and the ballast to the electrical contact with the battery. The circuitry delivers electrical energy from the power source through the dimmer switch(es) to the light generating assembly. The circuitry in combination with the ballast delivers electrical energy from the power source to the light generating assembly. The circuitry (14) includes on and off switch(es) for controlling the flow of electricity from the battery to the ballast. External electrical input jacks (not shown) may be provided to effect recharging of the battery.

External switches (19) are provided for each of the bulbs.

As seen in FIG. 1 the circuitry (14) can be provided with a single dimmer switch (16) which controls the intensity of light emitted from all the bulbs (12). Also there are external switches (19) which activate or deactivate the bulbs (12).

Figure 2:
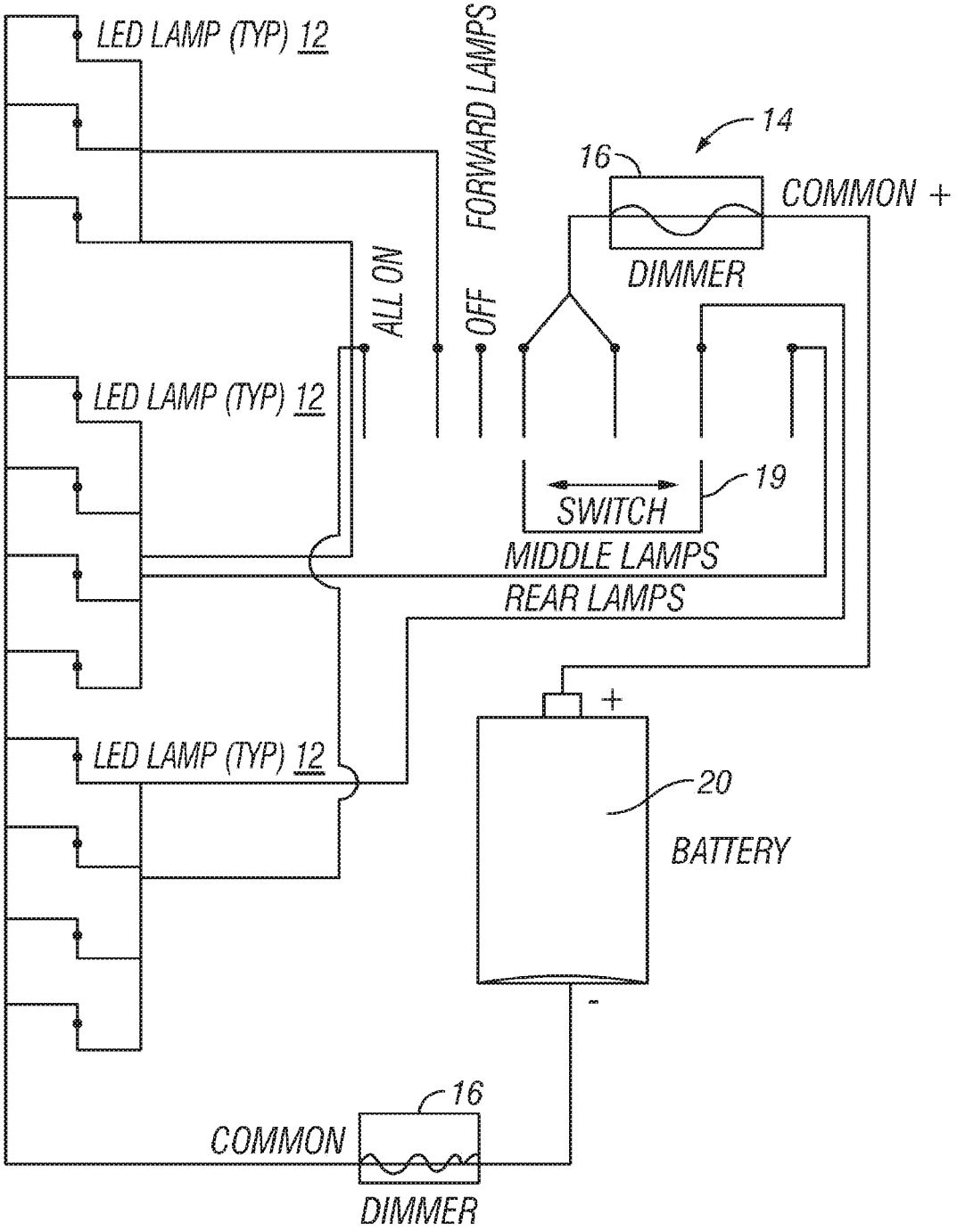
FIG. 2 is a circuit diagram wherein a dimmer controls all three bulbs in the invention.
Figure 3:
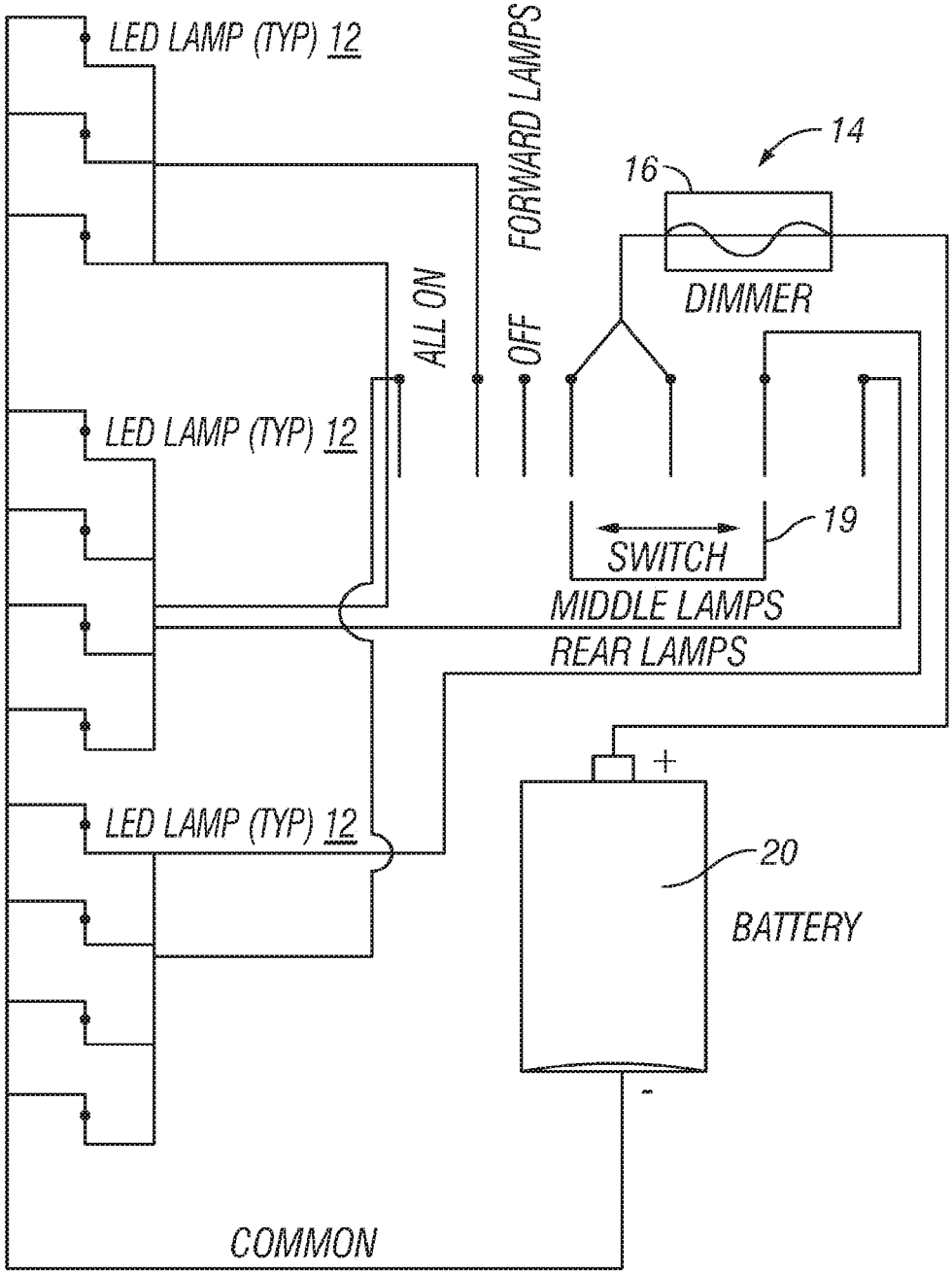
FIG. 3 is a circuit diagram wherein each bulb is controlled by a dimmer switch.

As shown in FIG. 2, the circuitry (14) comprises a dimmer switch (16) that controls the intensity of the electricity to each bulb so as to vary the degree of light intensity to each of the bulbs (12). This allows either side bulbs to be activated for viewing only the sides without light diffused from the center bulb which may interfere with sight.

The lens (18A) may comprise convex existing lens which act with the reflectors to form a concentrated light beam to each side and front of the flashlight.

Although the present invention has been described in terms of certain embodiments, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A lighting apparatus having a variable field of illumination comprising:

a housing having a light housing disposed adjacent an axial end of the housing, wherein the light housing comprises an open end having a length as measured between opposed side edges of the open end that is greater than a width as measured between opposed upper and lower edges of the open end;

a transparent cover connected with the light housing open end; and more than one light emitting elements disposed in the light housing, wherein one or more of the light emitting elements is placed at a center position between the light housing opposed side edges to direct light outwardly therefrom in a frontward direction, wherein one or more of the light emitting elements are placed away from the center position and near each of the light housing side edges to direct light in different sideward directions outwardly from the light housing, and wherein the lighting apparatus emits a field of illumination of at least 180 degrees as measured relative to an axis running parallel to the housing and through a center of the light housing.

2. The lighting apparatus as recited in claim 1 wherein at least one of the more than one light emitting elements are LEDs.

3. The lighting apparatus as recited in claim 1 wherein at least one of the more than one light emitting elements are bulbs with an incandescent filament.

4. The lighting apparatus as recited in claim 1 further comprising a reflector positioned within the light housing, wherein at least one of the more than one light emitting elements is associated with the reflector.

5. The lighting apparatus as recited in claim 1 where said transparent cover has a uniform thickness.

6. A lighting apparatus comprising:

a light housing having an open end with a length extending between opposed side edges that is greater than a width extending between opposed upper and lower edges;

more than one light emitting elements disposed within the light housing, wherein a light emitting element is placed adjacent a center position as measured between the opposed side edges to emit a frontward field of illumination, and wherein light emitting elements are placed away from the center position and near each of the opposed light housing opposed side edges to emit respective first and second sideward fields of illumination;

a transparent cover connected with the light housing;

wherein the more than one light emitting elements provide a field of illumination outwardly from the light housing of at least 180 degrees as measured relative to an axis running axially through a center of the light housing.

7. The lighting apparatus as recited in claim 6 comprising a reflector disposed in the light housing.

8. The lighting apparatus as recited in claim 6 wherein the lighting housing is attached to an end of a housing that includes a powder source.

9. The lighting apparatus as recited in claim 8 wherein the light emitting elements placed near the light housing opposed side edges provide the respective first and second sideward fields through respective side directed sections of the transparent cover that are positioned near respective opposed ends of a center section of the transparent cover.

10. The lighting apparatus as recited in claim 9 wherein a reflector is disposed in the housing and is associated with the light emitting element placed adjacent the center position to provide the frontward field of illumination.

11. A lighting apparatus comprising:

a light housing operatively connected with a power source, wherein the light housing has an open end having a length between opposed open end side edges that is greater than a width between opposed open end upper and lower edges;

more than one light emitting elements disposed within the light housing and positioned within the housing at different locations therein; and a transparent cover connected with the light housing open end;

wherein at least one of the light emitting elements is centrally positioned within the light housing to direct light outwardly in a forward direction from the light housing, wherein one or more of the light emitting elements are positioned within the light housing away from a center position and adjacent the first side edge to direct light outwardly in a first sideward direction from the light housing, and wherein one or more of the light emitting elements are positioned within the light housing away from the center position and adjacent the second side edge to direct light outwardly in a second sideward direction from the light housing, wherein together such light emitting elements operate to provide a field of illumination outwardly from the light housing of at least 180 degrees relative to an axis running axially through a center of the light housing.

12. The lighting apparatus as recited in claim 11 further comprising one or more reflectors disposed within the light housing and positioned adjacent at least one of the more than one light emitting elements, wherein at least one of the one or more light emitting elements is interposed between such reflector and the transparent cover.

* * * * *